US006561765B2

(12) United States Patent
Yu et al.

(10) Patent No.: US 6,561,765 B2
(45) Date of Patent: May 13, 2003

(54) FUEL PUMPS WITH REDUCED CONTAMINATION EFFECTS

(76) Inventors: DeQuan Yu, 3093 N. Foxridge Ct., Ann Arbor, MI (US) 48105; Paul Fisher, 3565 Edison St., Dexter, MI (US) 48130-1220

( * ) Notice: Subject to any disclaimer, the term of this patent is extended or adjusted under 35 U.S.C. 154(b) by 0 days.

(21) Appl. No.: 10/016,222

(22) Filed: Dec. 6, 2001

(65) Prior Publication Data

US 2002/0090293 A1 Jul. 11, 2002

Related U.S. Application Data

(62) Division of application No. 09/597,798, filed on Jun. 20, 2000, now abandoned.

(51) Int. Cl.[7] ..... F04D 29/66
(52) U.S. Cl. ..... 416/195; 416/194
(58) Field of Search ..... 416/195, 194, 416/196 R; 415/55.1–55.5

(56) References Cited

U.S. PATENT DOCUMENTS

| | | | |
|---|---|---|---|
| 2,724,544 | A | 11/1955 | Hardigg |
| 5,096,382 | A | 3/1992 | Gratzer |
| 5,310,308 | A | 5/1994 | Yu et al. |
| 5,409,357 | A | 4/1995 | Yu et al. |
| 5,498,124 | A | 3/1996 | Ito et al. |
| 5,551,835 | A | 9/1996 | Yu et al. |
| 5,702,229 | A | 12/1997 | Moss et al. |
| 5,961,276 | A | 10/1999 | Huebel et al. |

*Primary Examiner*—John Kwon
(74) *Attorney, Agent, or Firm*—John E. Kajander, Esq.

(57) ABSTRACT

A vehicle regenerative-type fuel pump which reduces the possible accumulation and effects of contamination relative to impellers with outer ring members. The impellers for the pump have outer ring members with non-uniform configurations (slanted, curved, grooved, etc.) which reduce the affects of contamination which can cause wear and roughing of the outer surface resulting in higher torque and reduced pump efficiencies.

10 Claims, 3 Drawing Sheets

FUEL PUMPS WITH REDUCED CONTAMINATION EFFECTS

CROSS-REFERENCE TO RELATED APPLICATIONS

This is a divisional of U.S. patent application Ser. No. 09/597,798 filed on Jun. 20, 2000 now abandoned.

TECHNICAL FIELD

The present invention relates to fuel pumps and more particularly to fuel pumps which reduce the possible accumulation and effects of contamination on the impellers.

BACKGROUND

Conventional tank-mounted automotive fuel pumps typically have a rotary pumping mechanism positioned within a housing. Fuel flows into a pumping chamber within the pump housing, and a rotary pumping element (e. g. impeller) causes the fuel to exit the housing at a high pressure. Regenerative fuel pumps are commonly used to pump fuel to automotive engines because they have a higher and more constant discharge pressure than, for example, positive displacement pumps. In addition, regenerative pumps typically cost less and generate less audible noise during operation.

In regenerative pumps of this type, fluid, such as gasoline, is pressurized and supplied by an impeller through the housing where the fluid cools the motor and is eventually supplied to the vehicle engine. The impeller is positioned in a cavity or chamber formed between an end cap and pump cover on the pump housing. An inlet port is situated on the end cap for introducing the fluid into the impeller chamber. The pump cover on the housing has a discharge port in which fuel pressurized by the impeller is discharged into the pump housing. Mating C-shaped grooves in the inner surfaces of the end cap and pump cover help direct fuel from the inlet port, around and through the impeller, and out the discharge port.

The impeller typically has a plurality of vanes around its perimeter which are used to pressurize the fuel in the impeller cavity and force it into the pump housing. The impeller also can have an outer ring around the perimeter of the vanes and adjacent a wall of the impeller cavity. Often, contamination from dust, sand and the like causes wear and roughening of the outer ring of the impeller, as well as on certain areas in the flow passageways and chambers in the end cap and pump cover. This can result in pumping losses, higher motor torque (thus higher current usage) decreased pump efficiency.

SUMMARY OF THE INVENTION

The present invention provides an improved fuel pump for supplying fuel to a vehicle engine from a fuel tank. The fuel pump includes a pump housing, a motor mounted within the housing and having a shaft extending therefrom, and an impeller mounted on the shaft for rotation therewith. The impeller is positioned in a cavity or chamber between a pump cover member connected to the pump housing and an end cap member. The impeller has a plurality of openings and radially outwardly extending vanes around its outer circumference and an outer ring attached to the outer end of the vanes.

The end cap member has an inlet port which directs fuel into the impeller chamber, while the pump cover member has an outlet port which discharges pressurized fuel from the impeller chamber into the pump housing. Fuel entering the pump housing passes by the motor and is directed to the vehicle engine.

A C-shaped groove or channel on the impeller chamber side of the end cap member communicates at one end with the inlet port. A mating C-shaped groove or channel on the impeller chamber side of the pump cover communicates at one end with the outlet port.

The outer surface of the impeller ring has a non-uniform configuration in order to reduce the contact surface of the impeller outer ring with the stationary pump components. The outer surface can be angled, rounded, scalloped, grooved or the like.

The outlet port on the pump housing cover has an enlarged opening (or "window") which reduces fuel restriction and increases the flow of fuel into the fuel pump. The larger passageway in turns helps wash out or push out any contaminants which could cause wear on the impeller, end cap and pump cover components.

The downstream end of the C-shaped groove in the end cap member is enlarged and angled radially outwardly in order to generate increased fuel flow through and past the impeller. This also decreases the opportunity for contamination to affect the vanes and outer surface of the impeller, and helps flush out any contamination which may have been deposited or built-up.

It is, therefore, an object of the present invention to provide an improved fuel pump mechanism with a ringed impeller which reduces potential contamination and its effects in and around the impeller and impeller chamber. It is another object of the present invention to change the speed and flow paths of contamination in the fuel pump and to guide and flow it out more easily from the impeller chamber in order to have less impact on the fuel pump components.

These and other objects and purposes of the present invention will become apparent from the following description of the invention when viewed in accordance with the attached drawings and appended claims.

DESCRIPTION OF THE PREFERRED EMBODIMENT(S)

Figure 1:
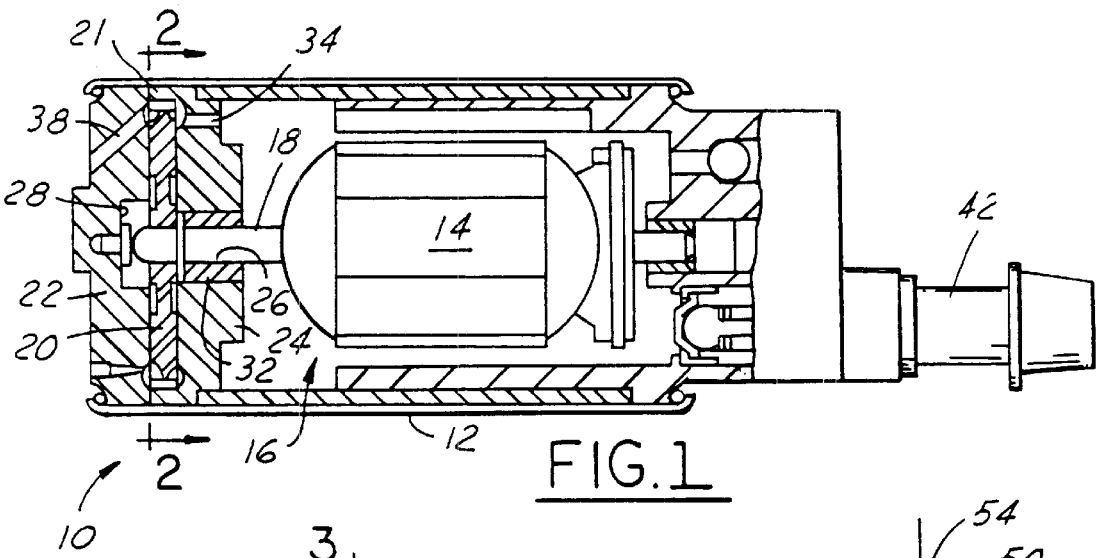
FIG. 1 is a cross-sectional view of a fuel pump according to the present invention.

Referring now to FIG. 1, a regenerative-type fuel pump 10 has a housing 12 in which the internal components are situated. A motor 14, preferably an electric motor, is mounted within cavity 16 for rotating a shaft 18 which extends from the motor toward the fuel inlet 38. A rotary pumping element, such as impeller 20, is positioned on the shaft 18 and positioned in cavity or chamber 21 between end cap member 22 and pump cover member 24 on the pump housing. The impeller 20 has a central axis which is coincident with the axis of the shaft 18. The shaft 18 passes through a shaft opening 26 in the pump cover member 22 through impeller 20 and into a recess 28 in the end cap member 22. The shaft 18 is journaled within bearing 32.

The pump cover member 24 has a fuel outlet port 34 leading into the motor cavity 16 from the pumping chamber 21 formed between the end cap member 22 and pump cover member 24. The end cap member has an inlet port 38 which supplies fuel to the impeller 20. Mating C-shaped annular grooves (described below) on the internal surfaces of the end cap member and the pump cover member are used to direct fuel around the impeller in the pumping chamber.

Pressurized fuel from the impeller chamber is discharged through fuel outlet port 34 to the motor cavity 16 where it cools the motor 14 as it passes over it to the pump outlet 42. The pump outlet 42 is on the opposite end of the pump 10 from the fuel inlet 38.

Figure 2:
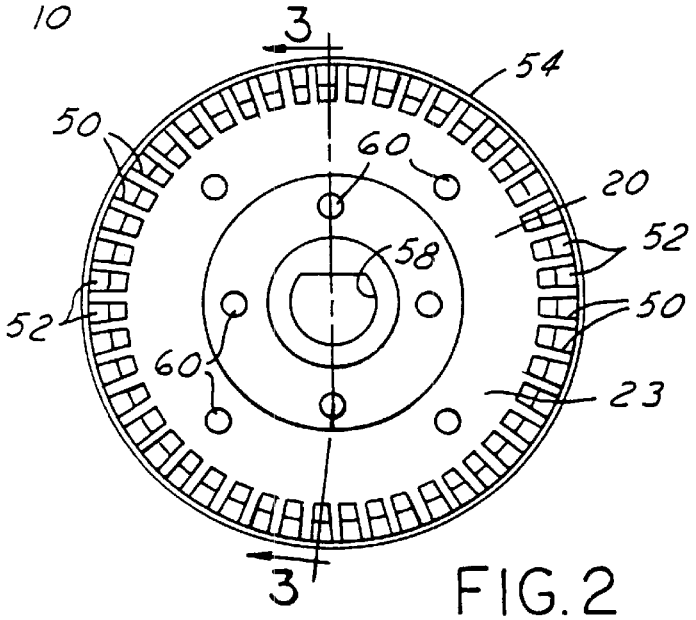
FIG. 2 is a sectional view along line 2—2 of FIG. 1 showing a rotary pumping element (impeller) according to the present invention.
Figure 3:
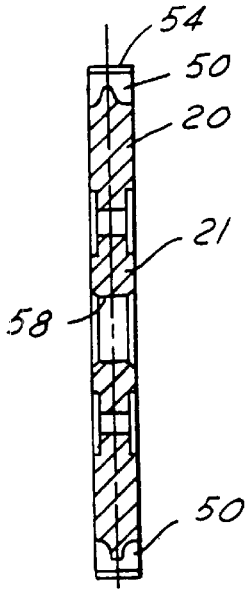
FIG. 3 is a sectional view along line 3—3 of the impeller shown in FIG. 2.

FIG. 2 is a partial section through the fuel pump 10 and depicts an elevational view of the impeller 20. FIG. 3 is a cross-sectional view of the impeller 20. Vanes 50 extend radially outwardly from the central body 23 of the impeller providing a series of openings 52 around the perimeter of the impeller. A ring member 54 is positioned around the outer periphery of the impeller and is connected to the outer ends of the vane members 50. The ring 54 reduces leakage of fuel around the impeller and improves low speed performance of the vehicle engine. Bore 58 is provided in the impeller 20 so it can be mounted on shaft 18. The impeller 20 is preferably symmetrical about its central axis and has an outer diameter of between 20–60 mm. A plurality of pressure balance holes 60 can be positioned in the impeller body 23 in order to balance or equalize the pressure on the two sides of the impeller in the impeller chamber 21. This allows the impeller to "float" between the internal surfaces of the end cap member and pump cover member and minimize frictional forces between the impeller and the cavity surfaces.

Figure 4:
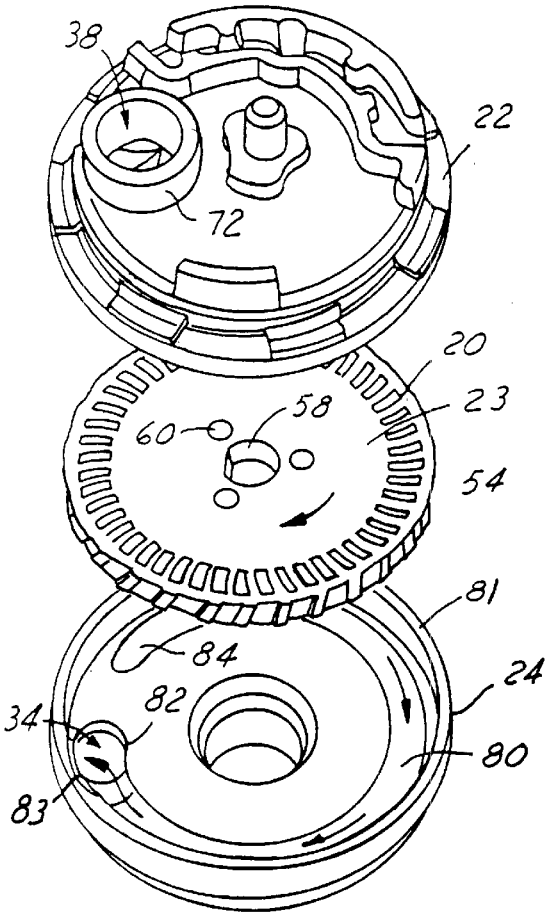
FIG. 4 is an exploded view of an end cap member, impeller, and pump cover member in accordance with the present invention when viewed from one direction.
Figure 5:
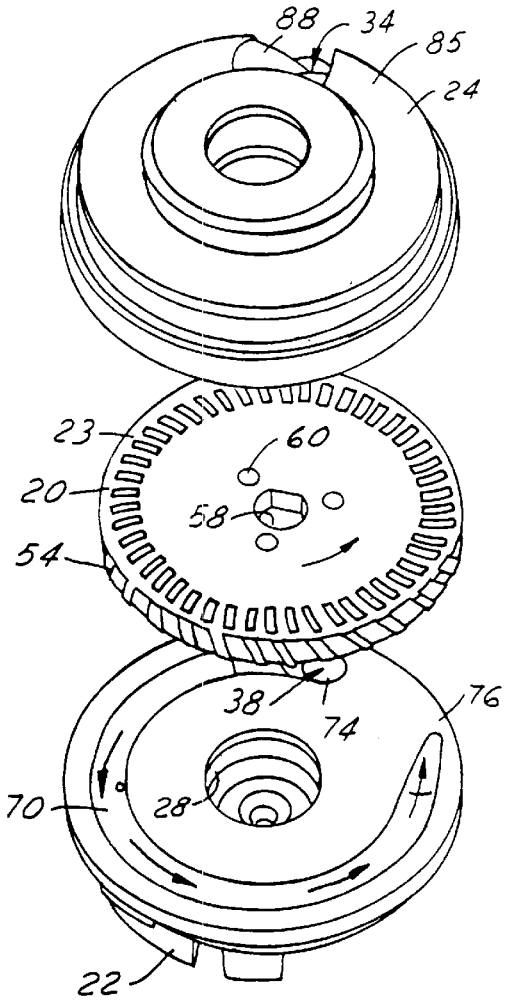
FIG. 5 is an exploded view of an end cap member, impeller, and pump cover member in accordance with the present invention when viewed from the other direction.

FIGS. 4 and 5 are exploded perspective views of the end cap member 22, impeller 20, and pump cover member 24 when viewed in opposite directions. As shown, the impeller 20 has a plurality of vanes and openings positioned between the impeller body 23 and the outer ring 54.

The end cap member 22 has an annular C-shaped groove or channel 70 on its internal surface adjacent the impeller 20 and an annular ring 72 on its external surface surrounding the inlet port 38. A vapor port 71 is provided along the groove 70 in order to exhaust fuel vapors in the impeller chamber back to the fuel tank and prevent vapor lock. As indicated above, the fuel in the fuel tank is drawn into inlet port 38, where is pressurized by the impeller 20 in the chamber 21 and exits through discharge port 34 in the pump cover member 24 into the motor housing 16. The pressurized fuel cools the motor 14 as it passes through the pump housing and is then discharged through outlet port 42 at the opposite end of the fuel pump where it is subsequently transported to the fuel filter, fuel rail, etc. of the vehicle engine and fuel system.

Figure 6:
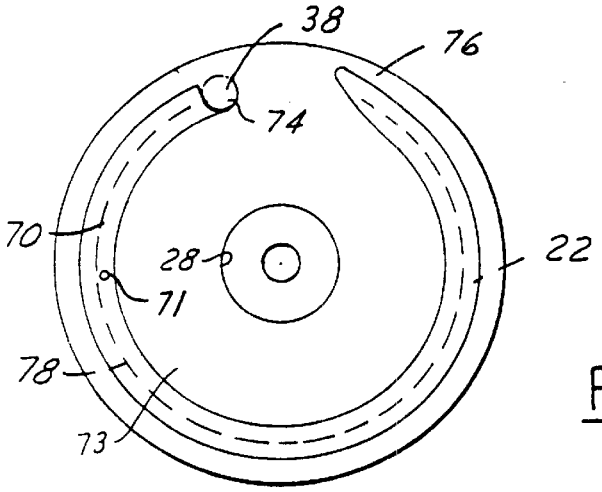
FIG. 6 is an elevational view of the impeller side of an end cap member in accordance with the present invention.

The C-shaped channel 70 on the end cap member 22 has an opening 74 at one end where the fuel enters from the inlet port 38 and a ramped surface 76 at the other end which is positioned adjacent discharge port 34 in the pump cover member 24. As shown in FIG. 6, the slanted or ramped end 76 is extended radially outwardly relative to the annular midpoint 78 of the C-shaped groove 70. This causes more of the fuel around the impeller to be directed around the perimeter of the outer ring 54 of the impeller as the fuel leaves the impeller cavity and enters into the discharge port 34 in the pump cover member 24.

The pump cover member 24 has a corresponding C-shaped groove or channel 80 which mates with the C-shaped groove 70 on the end cap member 22. Together, the two C-shaped grooves 70 and 80 provide a generally toroidal shaped channel for the fuel as it is pressurized by the impeller 20 in the impeller cavity 21. The C-shaped groove 80 in the pump cover member 24 has an enlarged opening 82 at one end and a flared or ramped surface 84 at the opposite end. The ramp surface 84 is positioned opposite the inlet port 38 in the end cap member when the fuel pump components are assembled together. Similarly, the opening 82 is positioned opposite to and in axial alignment with the ramped end 76 of the groove 70 in the end cap member 22.

Figure 8:
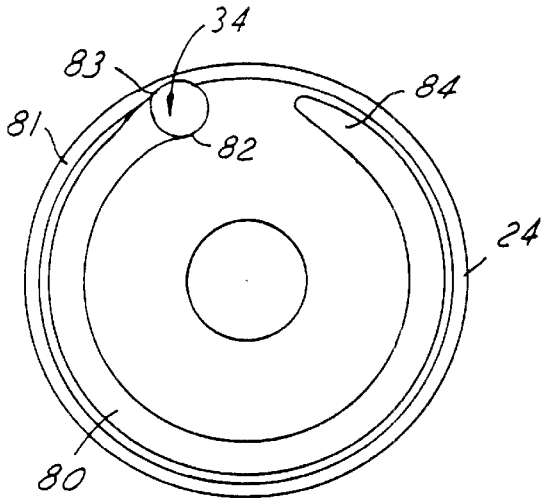
FIG. 8 is an elevational view of the impeller side of a pump cover member in accordance with the present invention.

As shown in FIG. 8, the opening 82 of discharge port 34, is enlarged and extended radially outwardly from the center of the pump cover member 24. A recess is also provided in the annular ridge or flange 81 of the pump housing cover 24 in order to allow enlargement of opening 82 and to allow increased fuel flow through the opening. The extended size and position of the opening 82 provides a larger area for fuel to flow from the impeller cavity 21 around the outer ring 54 of the impeller 20 and through the discharge port 34.

Figure 7:
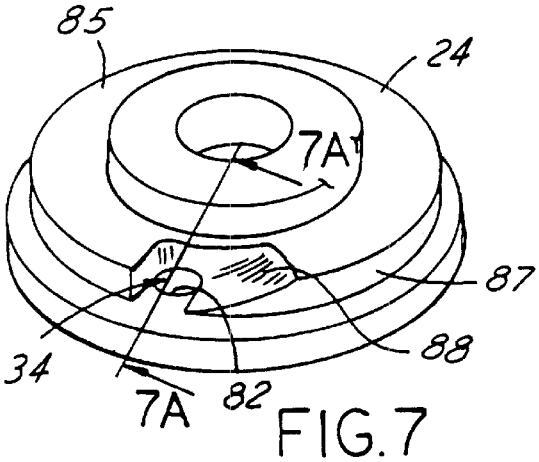
FIG. 7 is a perspective view of a pump cover member in accordance with the present invention.
Figure 7A:
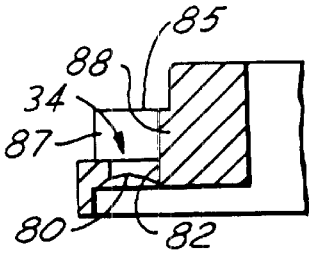
FIG. 7A is a cross-sectional view of a portion of the pump cover member shown in FIG. 7, the cross-section being taken along line 7A—7A in FIG. 7 and in the direction of the arrows.

Also, as shown in FIG. 7, the pump cover member 24 has an enlarged opening (or "window") 88 on the surface adjacent the pump motor 14. The window opens up not only in the end surfaces 85 of the pump cover member 24, but also in the side wall surface 87. This also provides for additional capacity of fuel to flow past the impeller, through the pump cover member 24 and into the motor cavity 16.

The combination of the radial outwardly angled end surface 76 of groove 70 on the end cap member, the enlarged opening 82 in the pump cover member 24 (together with recess 83 in flange 81) and the enlarged window 88 on the pump cover member, provides a fuel pump mechanism which increases the flow of fuel or fluid around the impeller ring (or outer periphery of the impeller) and assists in flushing out any contaminates and/or prevent the built-up of dust, sludge or other contaminates which can lead to pump losses and reduced pump efficiency.

Also to reduce the wearing effects of contamination in the fuel, particularly on the exterior surface of the outer ring 54 on the impeller 20, the outer ring has a non-uniform configuration, such as a curved, angled, scalloped, or grooved configuration or the like. This reduces the surface area of the outer ring which can be affected by the dirt, dust, sand, grit and the like which are the typical contaminants in vehicle fuel. These contaminants over time wear and roughen the surface of the impeller ring causing higher motor torque and decreased pump efficiency. Representative embodiments of the outer surface of the ring 54 which can accomplish this result are shown in FIGS. 9–12.

Typically, the clearance or space between the external surface or vanes of the impeller and the inner wall of the cavity 21 is on the order of 0.005–0.030 mm. This clearance is normally kept as small as possible in order to reduce leakage around the impeller resulting in pump losses and reduced pump efficiency. Also, the outer surface of impeller rings and the inner surface of the impeller cavity 21 are typically provided as smooth as possible in order to minimize contact of the impeller with the cavity or housing.

Figure 9:
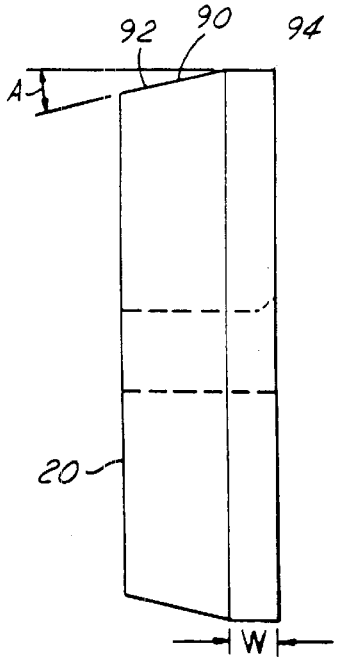
FIG. 9 is a side view of a first impeller embodiment in accordance with the present invention.

As shown in FIG. 9, the outer surface 90 of the impeller ring 100 has an angled portion or section 92 and a smaller planar or flat portion or section 94. The inclined surface 92 is defined by angle A which preferably is in the range from 0.1° to 5.0°, and more preferably about 1°. This embodiment provides a smaller axially extending area, namely section 94, which is adjacent the interior surface of the impeller cavity which, in turn, provides a smaller area to be affected by contamination and which can produce pumping losses. Preferably, the width W of the flat surface 94 is 1.0 millimeters or less. Similarly, the inclined surface assists in allowing an increased fluid flow over and around the outer perimeter of the impeller 20, which also decreases the opportunity for build-up of contaminants and helps flush out any contaminants which may have been deposited or built-up on the ring.

Figure 10:
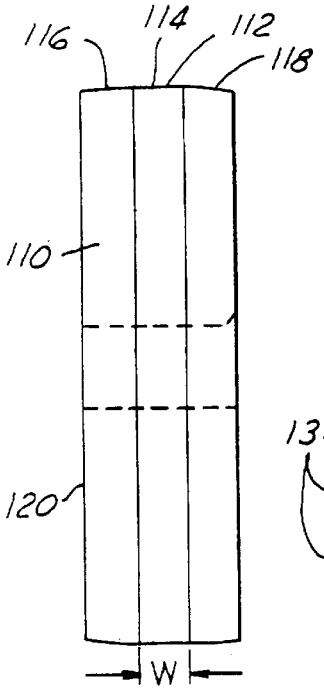
FIG. 10 is a side view of another embodiment of an impeller in accordance with the present invention.

In FIG. 10, the outer ring 110 of the impeller 120 has an essentially curved surface 112. The outer surface can have a continuous curved surface, or have a surface which is a plurality of short, straight surfaces, as shown, substantially forming an essentially curved surface. In FIG. 10, the outer surface 112 has a small flat or planar section 114 positioned between two angled or curved surfaces 116 and 118. Preferably the surface 114 which remains for close association with the impeller cavity surface, has a width W' of 1.0 millimeters or less. The angles of the surfaces 116 and 118 can be in the range of the angle A discussed above with respect to FIG. 9.

Figure 11:
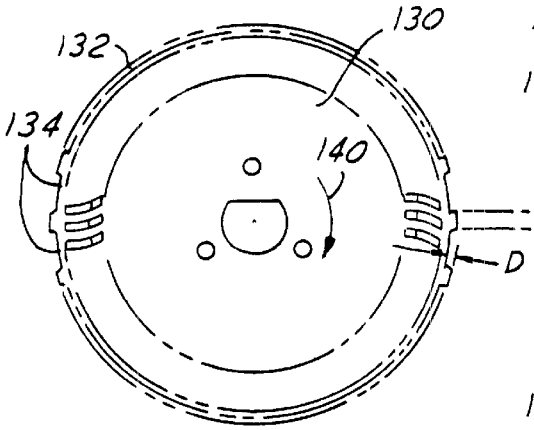
FIGS. 11 and 12 depict still another embodiment of an impeller in accordance with the present invention.
Figure 12:
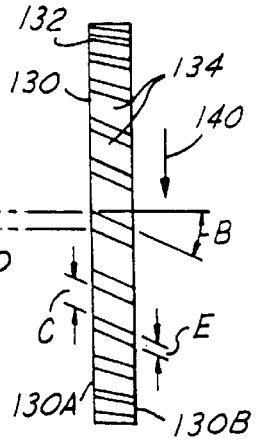

In the embodiment shown in FIGS. 11 and 12, the outer ring member 132 of impeller 130 has a plurality of scallops or grooves 134 which are formed uniformly around the outer circumference or perimeter. For this purpose, slots or slits could also be provided. As indicated, the scallops or grooves are slanted relative to the longitudinal axis of the fuel pump and slanted in a direction toward the direction of rotation of the impeller 130 which is shown by arrow 140. In this regard, surface 130A of impeller 130 is positioned adjacent the end cap member of the fuel pump assembly while surface 130B is positioned adjacent the pump cover member.

Preferably, the grooves 134 have a depth D of approximately 0.05 millimeters, an angle B of approximately 20–25°, a width C of approximately 2 mm., and a distance E between the grooves of approximately one millimeter.

As an alternate embodiment, the scallops and/or grooves in the outer ring of the impeller could be made sufficiently large and configured to only allow a few axially extending narrow bands of surface on the outer ring. For example, three, four or six bands, each on the order of 2–5 mm in width and 20 $\mu$m in height could be provided uniformly spaced around the circumference or periphery of the impeller. These "bumps" or ridges could also be used to clean potential contaminants between the impeller and adjacent inner annular wall of the pumping chamber 21.

With the present invention, any contamination, such as dust, sludge and the like, which might affect the impeller surface or be built-up in or around the impeller chamber is flushed and guided out more easily from the impeller chamber and through the pump cover member. In this manner, contamination will cause less damage to the impeller chamber and outlet port and will have less impact on fuel pump efficiency and output. The enlarged radially outward flow channel provides a smooth outlet from the impeller chamber and through the outlet port and helps guide the outwardly contamination flowing more easily. This, in turn, improves the efficiency of the pump.

The various alternative designs for the external surface of the outer ring on the impeller also reduce the surface area adjacent the inner walls of the impeller chamber and thus prevent possible buildup of contamination. As an added advantage, the slots, grooves, etc. in the surface of the outer ring of the impeller also produce a lifting force for the impeller away from the end cap member and thus further reduce the opportunity for undesirable frictional forces between the impeller and the adjacent end cap surface 73.

Regenerative type fuel pumps with rings on the outside of the impeller vanes are known today. These fuel pumps have a tendency to have a lower cost and higher efficiency, especially in the lower voltage/low speed ranges. However, this type of design also has a tendency to allow contamination to adversely affect the ring surface and possibly buildup in the impeller cavity reducing pump efficiencies. In the past, in order to resolve this concern, "prevent" designs were developed which reduced the clearance between the impeller ring and the impeller housing. However, these methods produced higher costs in the manufacturing process. Also, where contamination resulted, they reduced the efficiency of the fuel pump and often damaged the flow chamber, again causing impact on the fuel pump output.

While the invention has been described in connection with one or more embodiments, it is to be understood that the specific mechanisms and techniques which have been described are merely illustrative of the principles of the invention. Numerous modifications may be made to the methods and apparatus described without departing from the spirit and scope of the invention as defined by the appended claims.

What is claimed is:

1. An impeller for a pumping mechanism, said impeller having a central body portion, a plurality of vane members extending radially outwardly from said body portion, openings between each of said vane members, and an outer ring member positioned around and joining the outer ends of said vane members, said outer ring member having a first axial extending planar portion, and an adjacent second axial extending portion slanted radially toward said central body portion.

2. The impeller as set forth in claim 1 wherein said planar portion is smaller in axial length than said slanted portion.

3. The impeller as set forth in claim 1 wherein said slanted portion has an angle of 0.1° and 5.0°.

4. An impeller for a pumping mechanism, said impeller having a central body portion, a plurality of vane members extending radially outwardly from said body portion, openings between each of said vane members, and an outer ring member positioned around and connecting the outer ends of said vane members, said outer ring members having a circumferential surface formed of a plurality of flat planar surfaces.

5. An impeller for a pumping mechanism, said impeller having a central body portion, a plurality of vane members extending radially outwardly from said body portion, openings between each of said vane members, and an outer ring member positioned around and connecting the outer ends of said vane members, said outer ring members having an outer circumferential surface with a plurality of grooves thereon, said grooves being positioned at an angle relative to the axial direction of said central body portion.

6. The impeller as set forth in claim 5 wherein said angle is between 20° to about 25°.

7. The impeller as set forth in claim 5 wherein said grooves have a depth of about 0.05 mm and a width of about 2 mm.

8. The impeller as set forth in claim 5 wherein said grooves have a distance between them of about one millimeter.

9. The impeller as set forth in claim 5 wherein said grooves have a distance between them of about 2–5 mm and a depth of about 20 $\mu$m.

10. An impeller for a pumping mechanism, said impeller having a central body portion, a plurality of vane members extending radially outwardly from said body portion, openings between each of said vane members, and an outer ring member positioned around and connecting the outer ends of said vane members, said outer ring members having an outer circumferential surface which is curved in the axial direction of said central body portion.

* * * * *